US007708068B2

(12) United States Patent
Hailey, Jr.

(10) Patent No.: US 7,708,068 B2
(45) Date of Patent: May 4, 2010

(54) GRAVEL PACKING SCREEN WITH INFLOW CONTROL DEVICE AND BYPASS

(75) Inventor: Travis T. Hailey, Jr., Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 133 days.

(21) Appl. No.: 11/407,848

(22) Filed: Apr. 20, 2006

(65) Prior Publication Data

US 2007/0246213 A1 Oct. 25, 2007

(51) Int. Cl.
*E21B 43/04* (2006.01)
*E21B 43/08* (2006.01)

(52) U.S. Cl. ..... 166/278; 166/227; 166/228

(58) Field of Classification Search ..... 166/276, 166/278, 227, 228
See application file for complete search history.

(56) References Cited

U.S. PATENT DOCUMENTS

| | | | |
|---|---|---|---|
| 148,387 | A | 3/1874 | Squires |
| 1,536,348 | A | 5/1925 | Mack |
| 2,602,516 | A | 7/1952 | Gray |
| 2,762,437 | A | 9/1956 | Egan et al. |
| 2,809,654 | A | 10/1957 | Kraft |
| 2,849,070 | A | 8/1958 | Maly |
| 2,945,541 | A | 7/1960 | Maly |
| 2,981,332 | A | 4/1961 | Miller |
| 2,981,333 | A | 4/1961 | Miller |
| 3,477,506 | A | 11/1969 | Malone |
| 3,845,818 | A | 11/1974 | Deaton |
| 4,287,952 | A | 9/1981 | Erbstoesser |
| 4,491,186 | A | 1/1985 | Alder |
| 4,813,218 | A | 3/1989 | Claesson |
| 4,974,674 | A | 12/1990 | Wells |

(Continued)

FOREIGN PATENT DOCUMENTS

| | | |
|---|---|---|
| GB | 2314866 | 1/1998 |

(Continued)

OTHER PUBLICATIONS

Office Action issued for U.S. Appl. No. 11/668,024 dated Jan. 11, 2008 (18 pages).

(Continued)

*Primary Examiner*—Shane Bomar
(74) *Attorney, Agent, or Firm*—Marlin R. Smith

(57) ABSTRACT

A gravel packing screen with an inflow control device and a bypass. A well screen includes a flow restricting device for restricting inward flow through the screen, and a bypass device for increasing a proportion of the inward flow which passes through the flow restricting device, the bypass device including a material which swells in response to contact between the material and fluid in a well. A method of gravel packing a well includes installing a screen in the well, the screen including a flow restricting device which restricts flow through the screen, and a bypass device for selectively permitting relatively unrestricted flow through the screen; and actuating the bypass device in response to contact between a material of the bypass device and fluid in the well, thereby increasingly restricting flow through the screen. Flow through the flow restricting device and flow through the bypass device may be in parallel.

17 Claims, 9 Drawing Sheets

U.S. PATENT DOCUMENTS

| | | | |
|---|---|---|---|
| 4,998,585 | A | 3/1991 | Newcomer |
| 5,273,066 | A | 12/1993 | Graham et al. |
| 5,333,684 | A | 8/1994 | Walter |
| 5,337,808 | A | 8/1994 | Graham |
| 5,337,821 | A | 8/1994 | Peterson |
| 5,435,393 | A | 7/1995 | Brekke |
| 5,673,751 | A | 10/1997 | Head |
| 5,730,223 | A | 3/1998 | Restarick |
| 5,803,179 | A | 9/1998 | Echols |
| 5,896,928 | A | 4/1999 | Coon |
| 6,112,815 | A | 9/2000 | Boe |
| 6,112,817 | A | 9/2000 | Voll |
| 6,227,299 | B1 | 5/2001 | Dennistoun |
| 6,253,861 | B1 | 7/2001 | Carmichael |
| 6,305,470 | B1 | 10/2001 | Woie |
| 6,343,651 | B1 | 2/2002 | Bixenman |
| 6,371,210 | B1 | 4/2002 | Bode |
| 6,431,282 | B1 | 8/2002 | Bosma |
| 6,478,091 | B1 | 11/2002 | Gano |
| 6,505,682 | B2 | 1/2003 | Brockman |
| 6,516,888 | B1 | 2/2003 | Gunnarson |
| 6,622,794 | B2 | 9/2003 | Zisk |
| 6,644,412 | B2 | 11/2003 | Bode |
| 6,679,324 | B2 | 1/2004 | Den Boer |
| 6,695,067 | B2 | 2/2004 | Johnson |
| 6,719,051 | B2 | 4/2004 | Hailey |
| 6,786,285 | B2 | 9/2004 | Johnson |
| 6,817,416 | B2 | 11/2004 | Wilson |
| 6,834,725 | B2 | 12/2004 | Whanger |
| 6,851,560 | B2 | 2/2005 | Reig |
| 6,857,475 | B2 | 2/2005 | Johnson |
| 6,857,476 | B2 | 2/2005 | Richards |
| 6,883,613 | B2 | 4/2005 | Bode |
| 6,886,634 | B2 | 5/2005 | Richards |
| 6,907,937 | B2 | 6/2005 | Whanger |
| 6,957,703 | B2 | 10/2005 | Trott et al. |
| 7,013,979 | B2 | 3/2006 | Richard |
| 7,059,401 | B2 | 6/2006 | Bode |
| 7,063,162 | B2 | 6/2006 | Daling |
| 7,083,162 | B2 | 8/2006 | He |
| 7,096,945 | B2 | 8/2006 | Richards et al. |
| 7,100,686 | B2 | 9/2006 | Wittrisch |
| 7,108,083 | B2 | 9/2006 | Simonds et al. |
| 7,134,505 | B2 | 11/2006 | Fehr et al. |
| 7,185,706 | B2 | 3/2007 | Freyer |
| 7,191,833 | B2 | 3/2007 | Richards |
| 7,207,386 | B2 | 4/2007 | Brannon |
| 7,215,594 | B2 | 5/2007 | Im |
| 7,252,153 | B2 | 8/2007 | Hejl |
| 7,290,606 | B2 | 11/2007 | Coronado |
| 7,296,597 | B1 | 11/2007 | Freyer |
| 7,367,395 | B2 | 5/2008 | Vidrine |
| 7,426,962 | B2 | 9/2008 | Moen |
| 7,537,056 | B2 | 5/2009 | MacDougall |
| 2002/0056553 | A1 | 5/2002 | Duhon |
| 2004/0020662 | A1 | 2/2004 | Freyer |
| 2004/0035590 | A1 | 2/2004 | Richard |
| 2004/0060706 | A1 | 4/2004 | Stephenson |
| 2004/0108107 | A1 | 6/2004 | Wittrisch |
| 2004/0112609 | A1 | 6/2004 | Whanger |
| 2004/0144544 | A1 | 7/2004 | Freyer |
| 2005/0016732 | A1 | 1/2005 | Brannon |
| 2005/0110217 | A1 | 5/2005 | Wood |
| 2005/0173130 | A1 | 8/2005 | Richard |
| 2005/0199401 | A1 | 9/2005 | Patel et al. |
| 2006/0060352 | A1 | 3/2006 | Vidrine et al. |
| 2006/0076150 | A1 | 4/2006 | Coronado |
| 2006/0113089 | A1 | 6/2006 | Henriksen |
| 2006/0118296 | A1 | 6/2006 | Dybevik |
| 2006/0175065 | A1 | 8/2006 | Ross |
| 2006/0185849 | A1 | 8/2006 | Edwards |
| 2007/0044962 | A1 | 3/2007 | Tibbles |
| 2007/0246210 | A1 | 10/2007 | Richards |
| 2007/0246212 | A1 | 10/2007 | Richards |
| 2007/0246213 | A1 | 10/2007 | Hailey, Jr. |
| 2007/0246407 | A1 | 10/2007 | Richards et al. |
| 2008/0035330 | A1 | 2/2008 | Richards |
| 2008/0041580 | A1 | 2/2008 | Freyer |
| 2008/0041581 | A1 | 2/2008 | Richards |
| 2008/0041582 | A1 | 2/2008 | Saetre |
| 2008/0041588 | A1 | 2/2008 | Richards |
| 2008/0066912 | A1 | 3/2008 | Freyer |
| 2009/0008092 | A1 | 1/2009 | Haeberle et al. |
| 2009/0133869 | A1 | 5/2009 | Clem |

FOREIGN PATENT DOCUMENTS

| | | | |
|---|---|---|---|
| GB | 2356879 | | 6/2001 |
| GB | 2371578 | | 7/2002 |
| GB | 2341405 | | 3/2006 |
| WO | 2002075110 | | 9/2002 |
| WO | 2002090714 | A1 | 11/2002 |
| WO | 2004057715 | | 7/2004 |
| WO | 2005116394 | | 12/2005 |
| WO | 2006003112 | | 1/2006 |
| WO | 2006003113 | | 1/2006 |
| WO | 2008024645 | A2 | 2/2008 |
| WO | 2008024645 | A3 | 2/2008 |
| WO | 2009048822 | A2 | 4/2009 |
| WO | 2009048823 | A2 | 4/2009 |
| WO | 2009067021 | A2 | 5/2009 |

OTHER PUBLICATIONS

Office Action issued for U.S. Appl. No. 11/407,704 dated Jan. 14, 2008 (23 pages).

International Search Report and Written Opinion issued for International Application No. PCT/US07/75743 dated Feb. 11, 2008 (8 pages).

Office Action issued for U.S. Appl. No. 11/466,022 dated Feb. 8, 2008 (30 pages).

SPE 102208, "Means for Passive Inflow Control Upon Gas Breakthrough," dated Sep. 24-27, 2006.

SPE 25891, "Perforation Friction Pressure of Fracturing Fluid Slurries," dated Apr. 12-14, 1993.

U.S. Appl. No. 11/409,734 filed Apr. 24, 2006 .

U.S. Appl. No. 11/466,022 filed Aug. 21, 2006.

U.S. Appl. No. 11/668,024 filed Jan. 29, 2007.

U.S. Appl. No. 11/407,704 filed Apr. 20, 2006.

U.S. Appl. No. 11/502,074 filed Aug. 10, 2006.

U.S. Appl. No. 11/702,312 filed Feb. 5, 2007.

International Search Report for PCT/NO02/00158.

Weatherford Product Brochure, "Application Answers" dated 2005.

Office Action for U.S. Appl. No. 10/477,440 dated Jun. 14, 2006.

Examination report for GB 0707831.4 dated Jul. 16, 2007.

Office Action dated Jul. 10, 2008, for U.S. Appl. No. 11/668,024 (7 pages).

Office Action dated Aug. 26, 2008, U.S. Appl. No. 11/466,022 (8 pages).

Office Action issued Oct. 20, 2008, for U.S. Appl. No. 11/409,734, 30 pages.

Search Report and Written Opinion for PCT/US07/66991 dated Aug. 27, 2008.

Office Action issued Dec. 17, 2008, for U.S. Appl. No. 11/407,704, 17 pages.

Office Action issued Mar. 16, 2009, for U.S. Appl. No. 11/671,319, 47 pages.

International Search Report and Written Opinion issued Feb. 27, 2009, for International Patent Application Serial No. PCT/IB07/04287, 6 pages.

International Preliminary Report on Patentability and Written Opinion issued Mar. 5, 2009, for International Patent Application Serial No. PCT/US07/75743, 5 pages.

Office Action issued Apr. 1, 2009, for U.S. Appl. No. 11/407,704, 11 pages.

International Preliminary Report on Patentability and Written Opinion issued Mar. 26, 2009, for International Patent Application Serial No. PCT/US06/35052, 5 pages.

Office Action issued Apr. 14, 2009, for U.S. Appl. No. 11/409,734, 9 pages.

Office Action issued May 8, 2009, for U.S. Appl. No. 11/851,354, 17 pages.

Examiner's Answer issued Aug. 21, 2009, for U.S. Appl. No. 11/466,022, 8 pages.

Office Action issued Nov. 12, 2009, for U.S. Appl. No. 11/409,734, 17 pages.

Office Action issued Nov. 3, 2009, for U.S. Appl. No. 11/851,354, 10 pages.

Examiner's Answer issued Nov. 30, 2009, for U.S. Appl. No. 11/407,704, 22 pages.

GRAVEL PACKING SCREEN WITH INFLOW CONTROL DEVICE AND BYPASS

BACKGROUND

The present invention relates generally to equipment utilized and operations performed in conjunction with a subterranean well and, in an embodiment described herein, more particularly provides a gravel packing screen with an inflow control device and a bypass.

Although some wells can be completed with sand control screens for controlling sand production, many wells are benefited by additionally having a gravel pack placed around the screens. Furthermore, some well completions are benefited by having flow restrictors, such as inflow control devices, integral to the screens to restrict the flow of produced fluid through the screens. In some cases, the inflow control devices may variably restrict the fluid flow, and may have the capability to respond to changed downhole conditions and/or be remotely controlled (e.g., "intelligent" inflow control devices). Very long horizontal open hole completions can benefit substantially from the use of inflow control devices in screens.

In spite of these facts, few (if any) wells have been completed with a screen having an integral inflow control device and with a gravel pack installed about the screen. This may be due to the fact that the presence of the inflow control device integral to the screen would impair or prevent the successful placement of the gravel pack around the screen when using conventional slurry pumping techniques, since the inflow control device significantly restricts the available flow rate through the screen during the gravel packing operation. Conventional slurry pumping techniques require a much greater flow rate through the screen at certain points in the gravel packing operation than is practically possible with the inflow control device in place.

Therefore, it may be seen that improvements are needed in the arts of well screen construction and gravel packing. It is among the objects of the present invention to provide such improvements.

SUMMARY

In carrying out the principles of the present invention, a new well screen and associated methods are provided which solve at least one problem in the art. One example is described below in which a screen includes an inflow control device and a bypass to divert flow around the inflow control device. Another example is described below in which a gravel packing operation is conducted while the bypass is open, and then the bypass is closed so that flow is no longer diverted around the inflow control device during production.

In one aspect of the invention, a well screen includes a flow restricting device for restricting inward flow through the screen. A bypass device is used to vary a proportion of the inward flow which passes through the flow restricting device. The bypass device includes a material which swells in response to contact between the material and fluid in a well.

In another aspect of the invention, a method of gravel packing a well includes the steps of: installing a well screen in the well, the screen including a flow restricting device which restricts flow through the screen, and a bypass device for selectively permitting relatively unrestricted flow through the screen; and actuating the bypass device in response to contact between a material in the bypass device and fluid in the well, thereby increasingly restricting flow through the screen.

In yet another aspect of the invention, a well system is provided. The well system includes a well screen with a flow restricting device for restricting inward flow through the screen, and a bypass device for increasing a proportion of the inward flow which passes through the flow restricting device. The bypass device includes a material which swells in response to contact between the material and fluid in the well.

In a further aspect of the invention, a method of gravel packing a well includes the step of: installing a well screen in the well, the screen including a flow restricting device which restricts flow through the screen, and a bypass device for selectively permitting relatively unrestricted flow through the screen. Flow through the flow restricting device and flow through the bypass device are in parallel. The method further includes the step of actuating the bypass device, thereby increasingly restricting flow through the screen.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
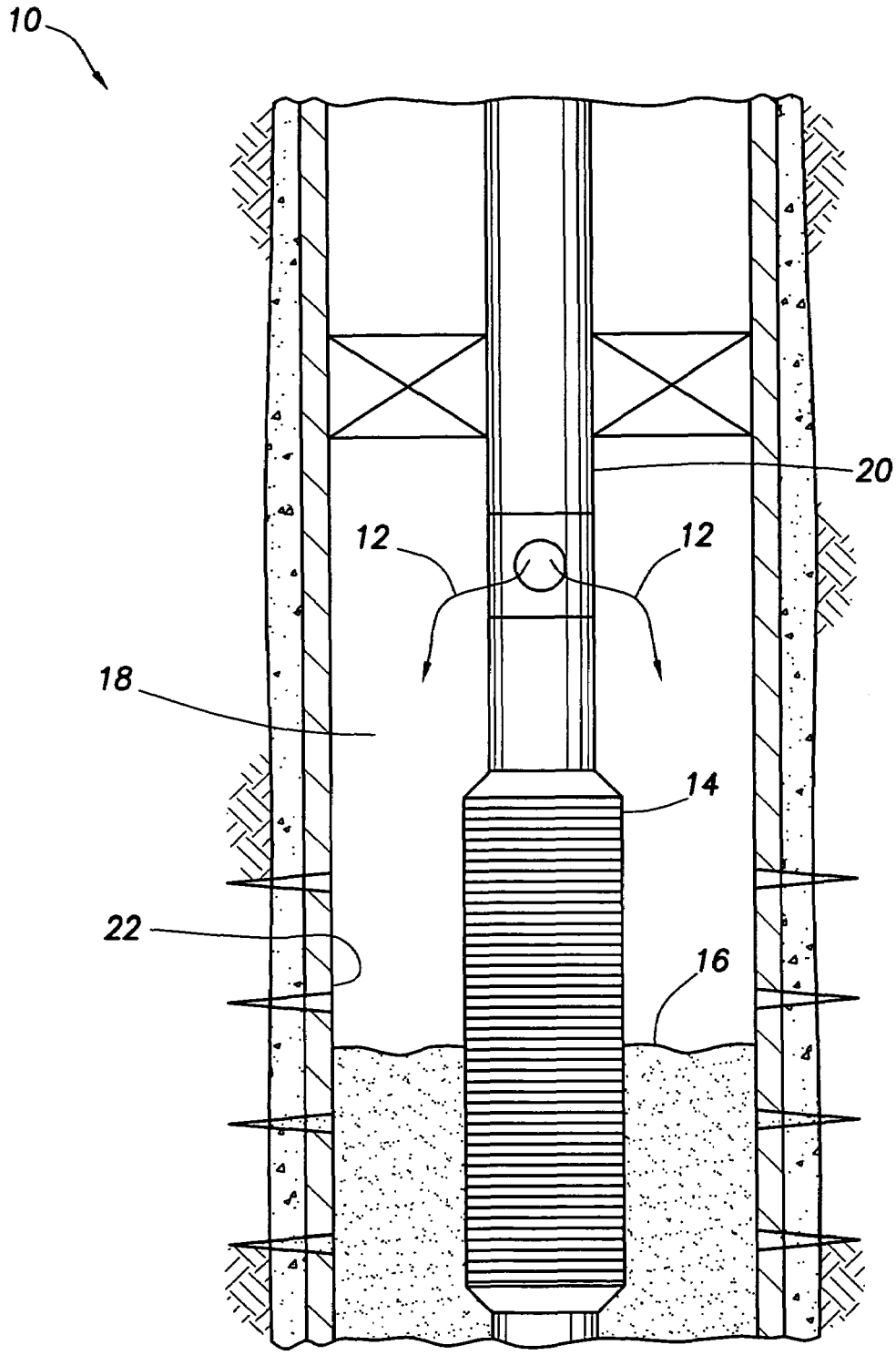
FIG. 1 is a schematic partially cross-sectional view of a well system embodying principles of the present invention.

Representatively illustrated in FIG. 1 is a well system 10 which embodies principles of the present invention. A gravel packing method is being performed in the well system 10 as depicted in FIG. 1, with a gravel slurry 12 being flowed into an annulus 18 between a completion string 20 and a wellbore 22. In this manner, a gravel pack 16 is installed about a well screen 14 interconnected in the completion string 20.

In one important feature of the well system 10, the well screen 14 is provided with a flow restricting device for restricting inward flow through the screen during production, and is also provided with a bypass device which permits relatively unrestricted inward flow through the screen until after the gravel packing operation. This feature allows greater flow rates through the screen 14 before and during the gravel packing operation, but also obtains the benefits of reduced flow rates through the screen during production.

Although the wellbore 22 is depicted in FIG. 1 as being cased, it should be understood that the wellbore could be completed open hole in keeping with the principles of the invention. In addition, although the screen 14 is shown as being positioned in a generally vertical portion of the wellbore 22, such screens may alternatively, or in addition, be positioned in horizontal or otherwise deviated portions of a wellbore.

Figure 2:
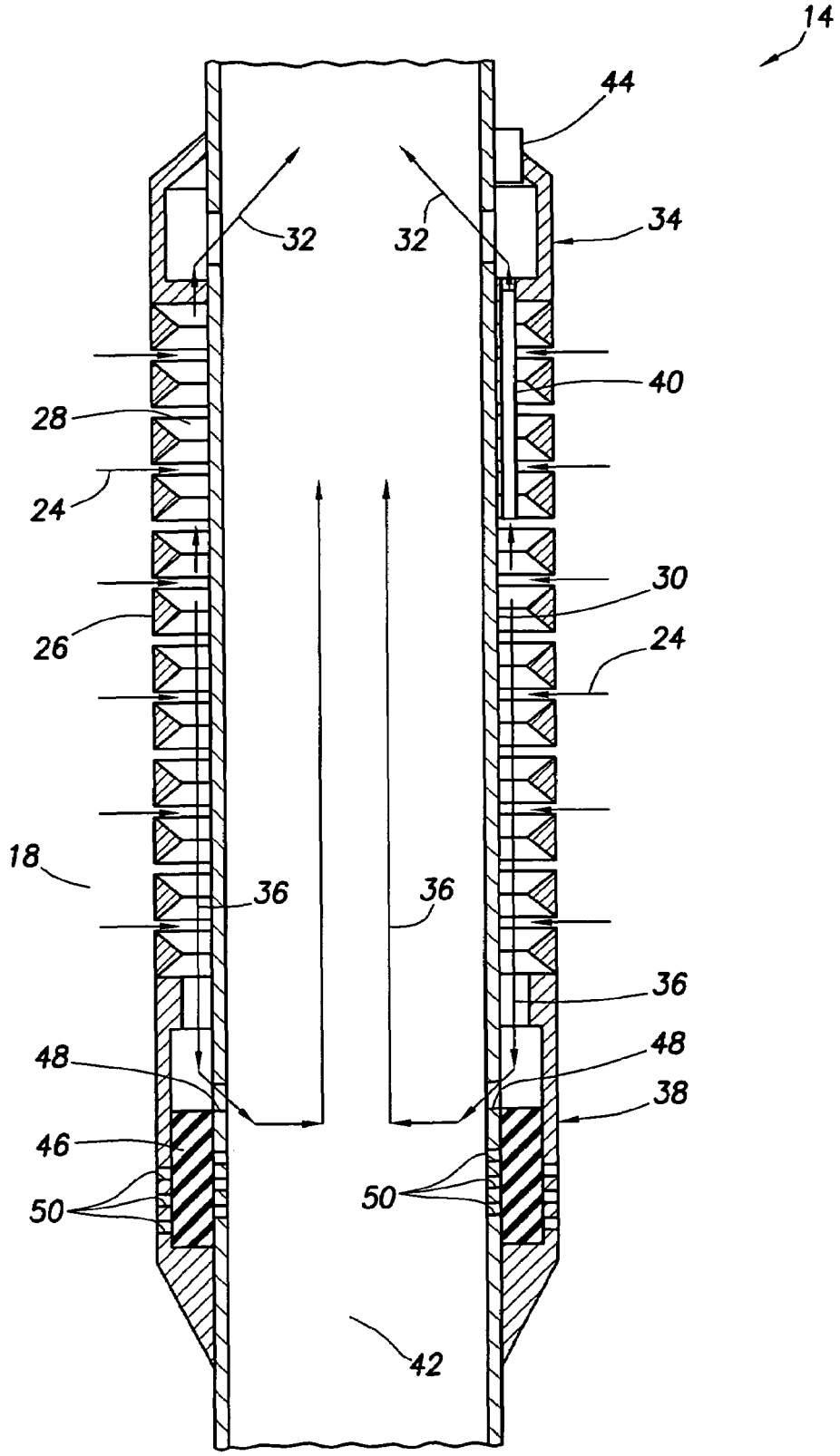
FIG. 2 is an enlarged scale schematic cross-sectional view through a well screen in the system of FIG. 1.

Referring additionally now to FIG. 2, an enlarged scale cross-sectional view of the screen 14 is representatively illustrated. This view depicts the screen 14 during the gravel packing operation.

A fluid portion 24 of the gravel slurry 12 flows inwardly through a filter portion 26 of the screen 14. The filter portion 26 is depicted in FIG. 2 as being made up of wire wraps, but other types of filter material (such as mesh, sintered material, etc.) may be used in other embodiments.

The fluid portion 24 enters an annular space 28 between the filter portion 26 and a tubular base pipe 30 of the screen 14. A portion 32 of the fluid then passes through a flow restricting device 34, and another portion 36 of the fluid passes through a bypass device 38.

The bypass device 38 permits relatively unrestricted inward flow through the screen 14 prior to and during the gravel packing operation. However, the bypass device 38 can be actuated to increase the proportion of fluid which passes through the flow restricting device 34, thereby increasing the restriction to flow through the screen, as described more fully below.

The flow restricting device 34 may be of the type known to those skilled in the art as an inflow control device. As depicted in FIG. 2, the device 34 utilizes relatively small diameter tubes 40 (only one of which is visible in FIG. 2) to restrict inward flow through the screen 14 (i.e., between the annulus 18 and an inner passage 42 formed through the screen).

However, it should be clearly understood that any type of flow restricting device may be used for the device 34 in keeping with the principles of the invention. For example, some inflow control devices use tortuous passages, orifices and/or other flow restricting elements to restrict inward flow through a screen.

In addition, the flow restricting device 34 may be "intelligent" in that the device may be remotely controlled and/or the device may be capable of responding to changed downhole conditions in order to variably restrict inward flow through the screen 14. For this purpose, the device 34 may include a downhole controller 44 which may include a telemetry device for communicating with the surface or another remote location.

Preferably, the flow restricting device 34 is an integral part of the screen 14, so that the flow restricting device is installed when the screen is installed in the well system 10. In this manner, an intervention into the well is not required to install the flow restricting device 34. However, other configurations are possible in keeping with the principles of the invention.

The bypass device 38 includes a material 46 which swells (increases in volume) when contacted with a certain fluid in the well. For example, the material 46 could swell in response to contact with water, in response to contact with hydrocarbon fluid, or in response to contact with gas in the well, etc. Ports 50 may be provided in the bypass device 38 to increase a surface area of the material 46 exposed to the fluid in the well.

Examples of swellable materials are described in U.S. patent application publication nos. 2004-0020662, 2005-0110217, 2004-0112609, and 2004-0060706, the entire disclosures of which are incorporated herein by this reference. Other examples of swellable materials are described in PCT patent application publication nos. WO 2004/057715 and WO 2005/116394, the entire disclosures of which are incorporated herein by this reference.

The bypass device 38 also includes ports or passages 48 through which the fluid portion 36 flows prior to and during the gravel packing operation. Note that in FIG. 2 the material 46 permits relatively unrestricted flow of the fluid portion 36 through the passages 48.

Preferably, the bypass device 38 is an integral part of the screen 14, so that the bypass device is installed when the screen is installed in the well system 10. In this manner, an intervention into the well is not required to install the bypass device 38. However, other configurations are possible in keeping with the principles of the invention.

Figure 3:
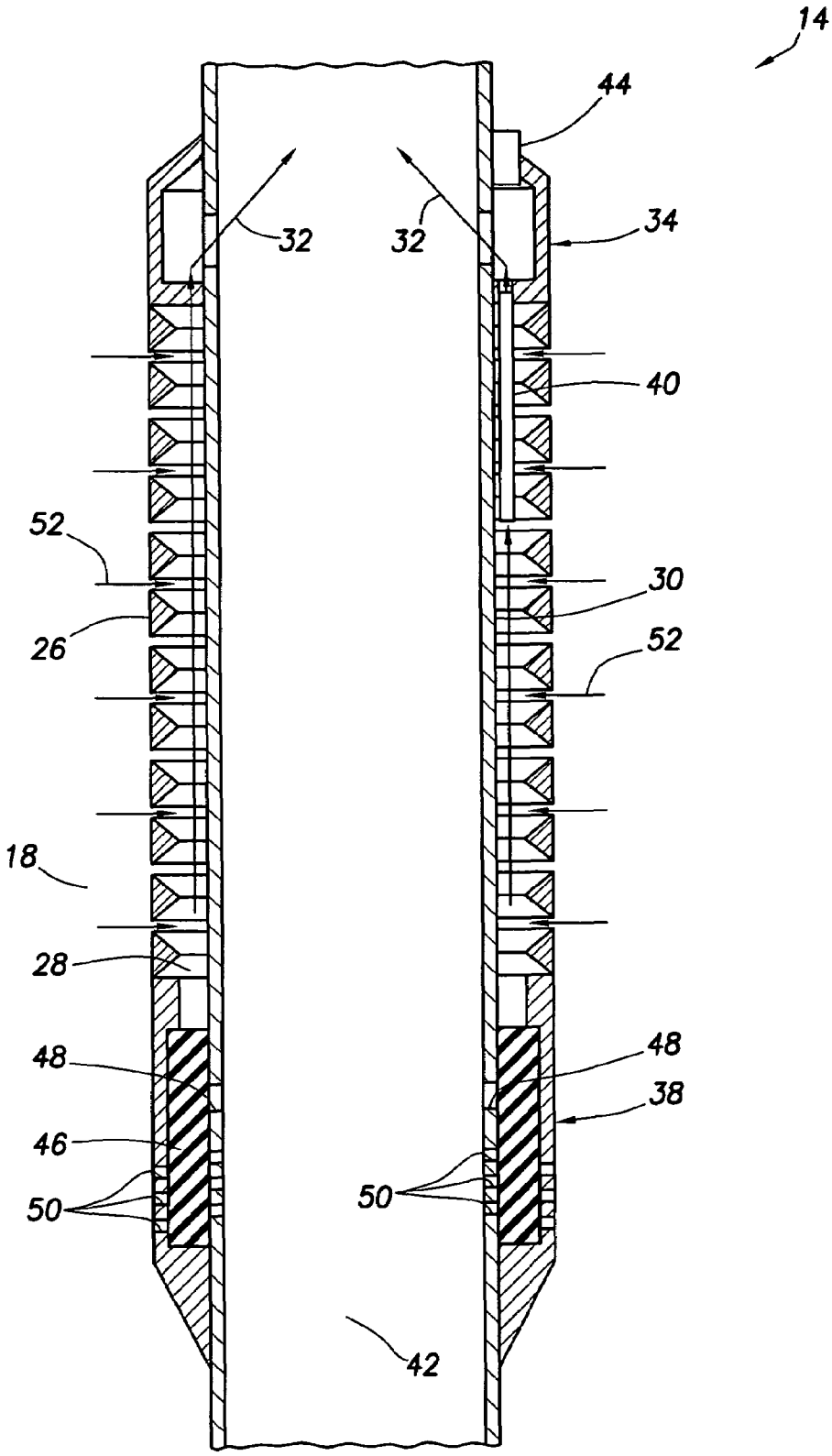
FIG. 3 is a schematic cross-sectional view of the well screen of FIG. 2, with a bypass device of the screen being closed.

Referring additionally now to FIG. 3, the screen 14 is representatively illustrated after the material 46 has swollen in response to contact with a fluid in the well. Flow through the passages 48 is now prevented, and all of the inward flow through the screen 14 must pass through the flow restricting device 34. In this manner, inward flow through the screen 14 is increasingly restricted due to swelling of the material 46.

The swollen material 46 itself blocks flow through the passages 48. However, note that it is not necessary for the material 46 to completely prevent flow through the passages 48, since it may be sufficient in some circumstances for the material to just increasingly restrict flow through the passages.

After the gravel packing operation, all (or at least an increased proportion) of the inward flow passes through the flow restricting device 34, rather than through the bypass device 38. Thus, the fluid portion 32 will consist of fluid 52 produced through the filter portion 26.

Swelling of the material 46 could be initiated during or after the gravel packing operation by, for example, circulating a certain fluid down to the screen 14 with, or after, the slurry 12. Alternatively, the produced fluid 52 could contact the material 46 and cause it to swell after the gravel packing operation.

As another alternative, the swelling of the material 46 could be initiated by the same fluid as is in the well at the time that the screen 14 and its bypass device 38 are installed in the well. In that case, the swelling of the material 46 could be retarded, so that the closure or increased restriction through the bypass device 38 would not be completed until a desired subsequent time, such as after the gravel packing operation is at least substantially complete. The swelling of the material 46 could be retarded by, for example, designing the material composition so that it swells slowly, covering the material with another material which is only slowly penetrable by the well fluid or swells at a relatively slow rate, providing a cover or coating on the material to limit contact between the material and the well fluid, etc.

Any manner of contacting the material 46 with the fluid which causes the material to swell may be used at any time, and initiation of the contact between the material and the well fluid to cause the material to swell may occur at any time, in keeping with the principles of the invention.

Figure 4:
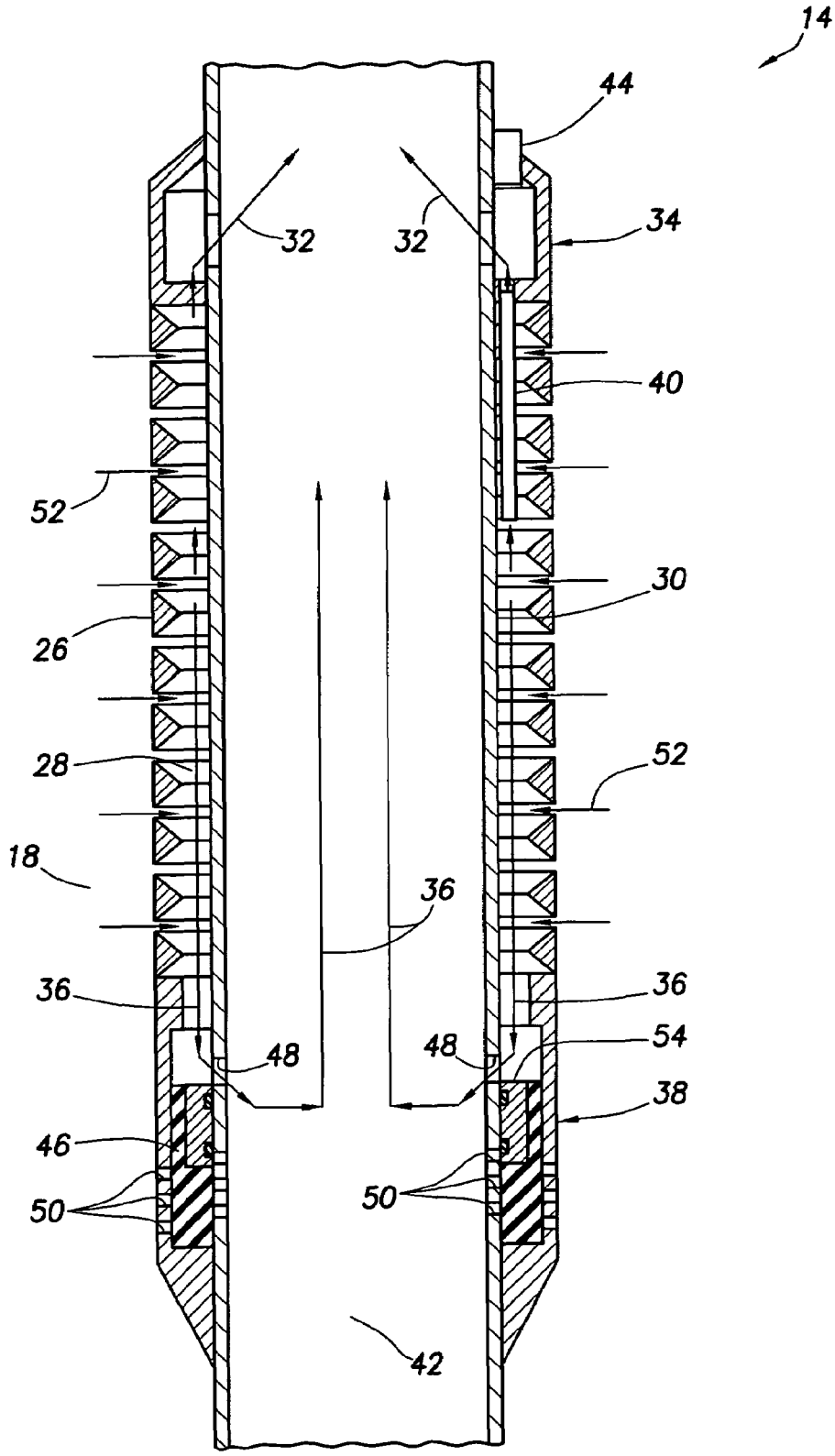
FIG. 4 is a schematic cross-sectional view of a first alternate construction of the well screen.

Referring additionally now to FIG. 4, an alternate configuration of the screen 14 is representatively illustrated. In this configuration, the bypass device 38 further includes a closure member 54 which is displaced by the material 46.

The member 54 is in the form of a sleeve which carries spaced apart internal seals. Other types of closure or choking members may be used without departing from the principles of the invention.

As depicted in FIG. 4, relatively unrestricted flow is permitted through the passages 48. Thus, a greater proportion of fluid flows through the bypass device 38, instead of through the flow restricting device 34.

Figure 5:
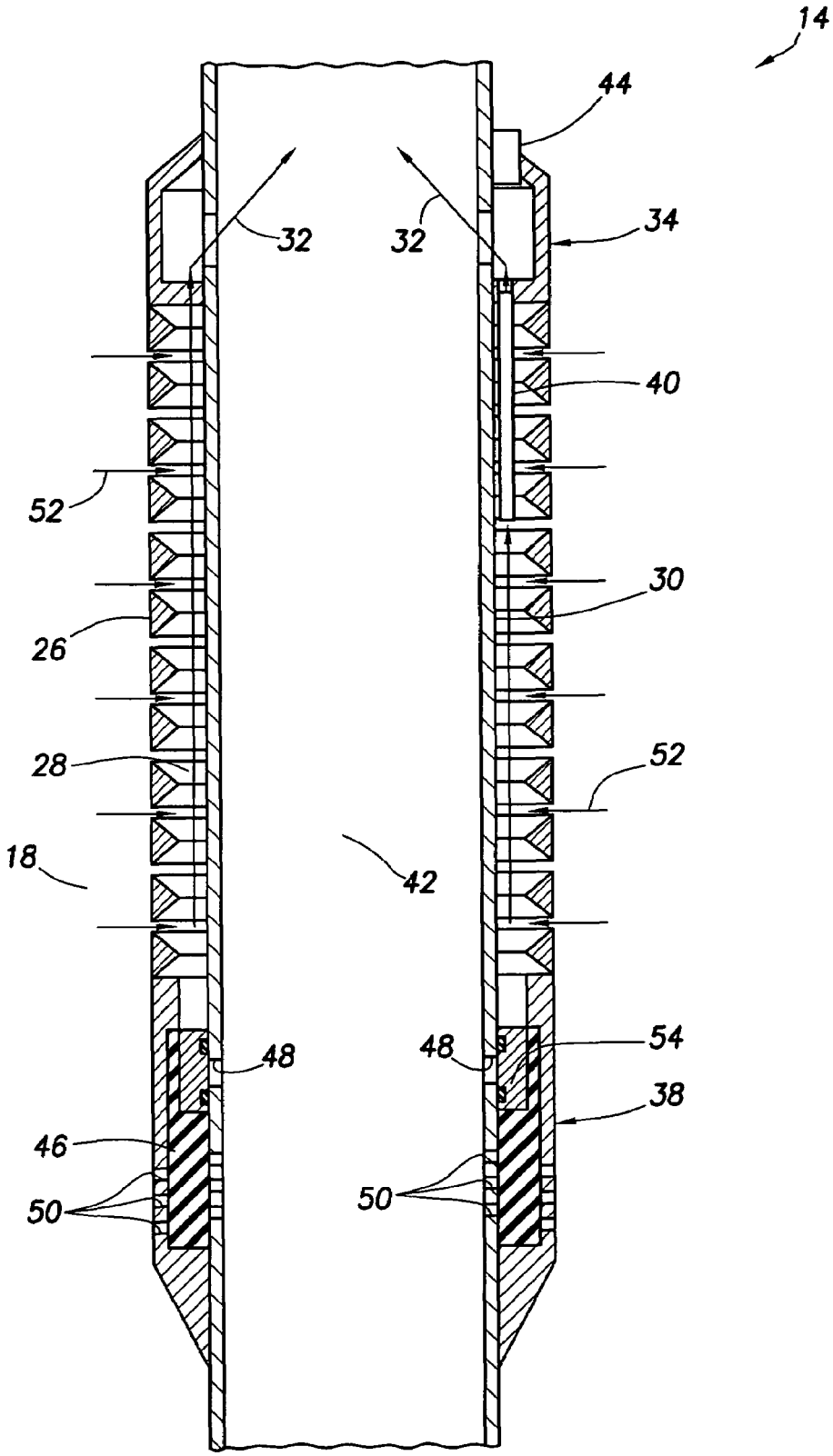
FIG. 5 is a schematic cross-sectional view of the well screen of FIG. 4, with a bypass device of the screen being closed.

Referring additionally now to FIG. 5, the alternate configuration of the screen 14 is representatively illustrated after the material 46 has been swollen. Swelling of the material 46 has caused the member 54 to displace to a position in which the member blocks the passages 48, preventing flow through the passages.

It is not necessary for the member 54 to completely prevent flow through the passages 48, since in some circumstances it may be acceptable for flow through the passages to be increasingly restricted. Preferably, at least a greater proportion of fluid is forced to flow through the flow restricting device 34, rather than through the bypass device 38, due to the displacement of the member 54.

In the constructions of the screen 14 as depicted in FIGS. 2-5, the bypass device 38 operates as a valve or choke to variably restrict flow through the passages 48. In the constructions of FIGS. 4 & 5, the material 46 is an actuator for the valve, since the material supplies the force required to block flow through the passages 48. The material 46 is also a closure member in the construction of the screen 14 as depicted in FIGS. 2 & 3.

Figure 6:
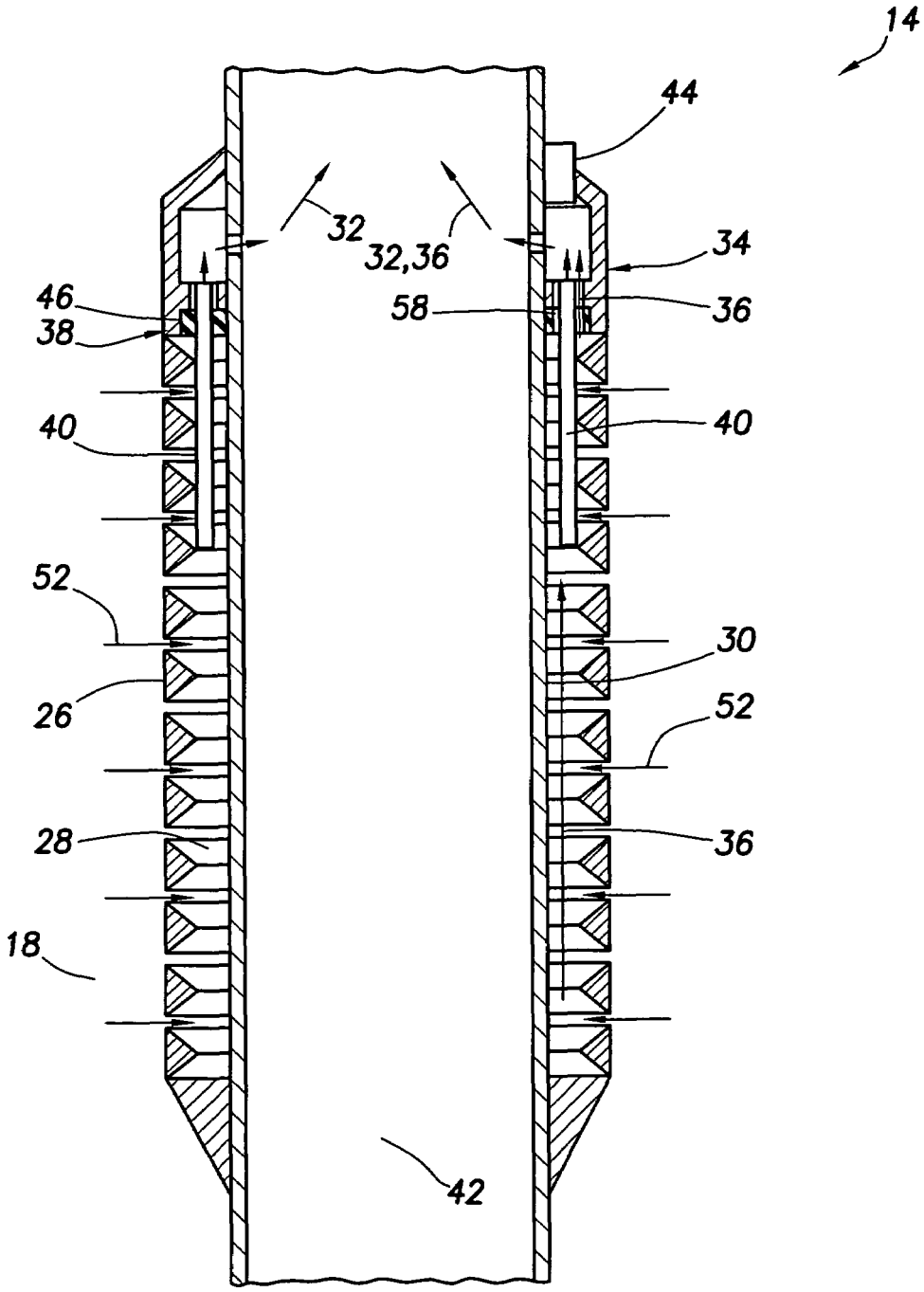
FIG. 6 is a schematic cross-sectional view of a second alternate construction of the well screen, a bypass device of the screen being shown closed on a left-hand side of the figure, and the bypass device of the screen being shown open on a right-hand side of the figure.

Referring additionally now to FIG. 6, another alternate configuration of the well screen 14 is representatively illustrated. In this configuration, the flow restricting device 34 and bypass device 38 are both incorporated into an upper end of the screen 14. On a right-hand side of the screen 14 as viewed in FIG. 6 the bypass device 38 is open, and on a left-hand side of the screen the material 46 has swollen to close the bypass device.

The flow restricting device 34 and bypass device 38 are depicted in FIGS. 2-5 as being separate elements of the screen 14. However, the configuration of FIG. 6 demonstrates that these elements may be combined into a single structure, and that a variety of alternate constructions may be used in the screen 14 in keeping with the principles of the invention.

Prior to and during a gravel packing operation, relatively unrestricted flow is permitted through an annular passage 58 of the bypass device 38 as depicted on the right-hand side of FIG. 6. The annular passage is formed between the material 46 and the tube 40. The fluid portion 36 flows through this passage 58.

More restricted flow is also permitted through a relatively small diameter passage (not visible in FIG. 6) formed in the tubes 40. The fluid portion 32 flows through the tubes 40.

When the material 46 swells, it blocks (or at least increasingly restricts) flow through the passage 58, so that a greater proportion of fluid is forced to flow through the tubes 40. In this manner, the restriction to fluid flow through the bypass device 38 may be increased during or after the gravel packing operation.

Figure 7:
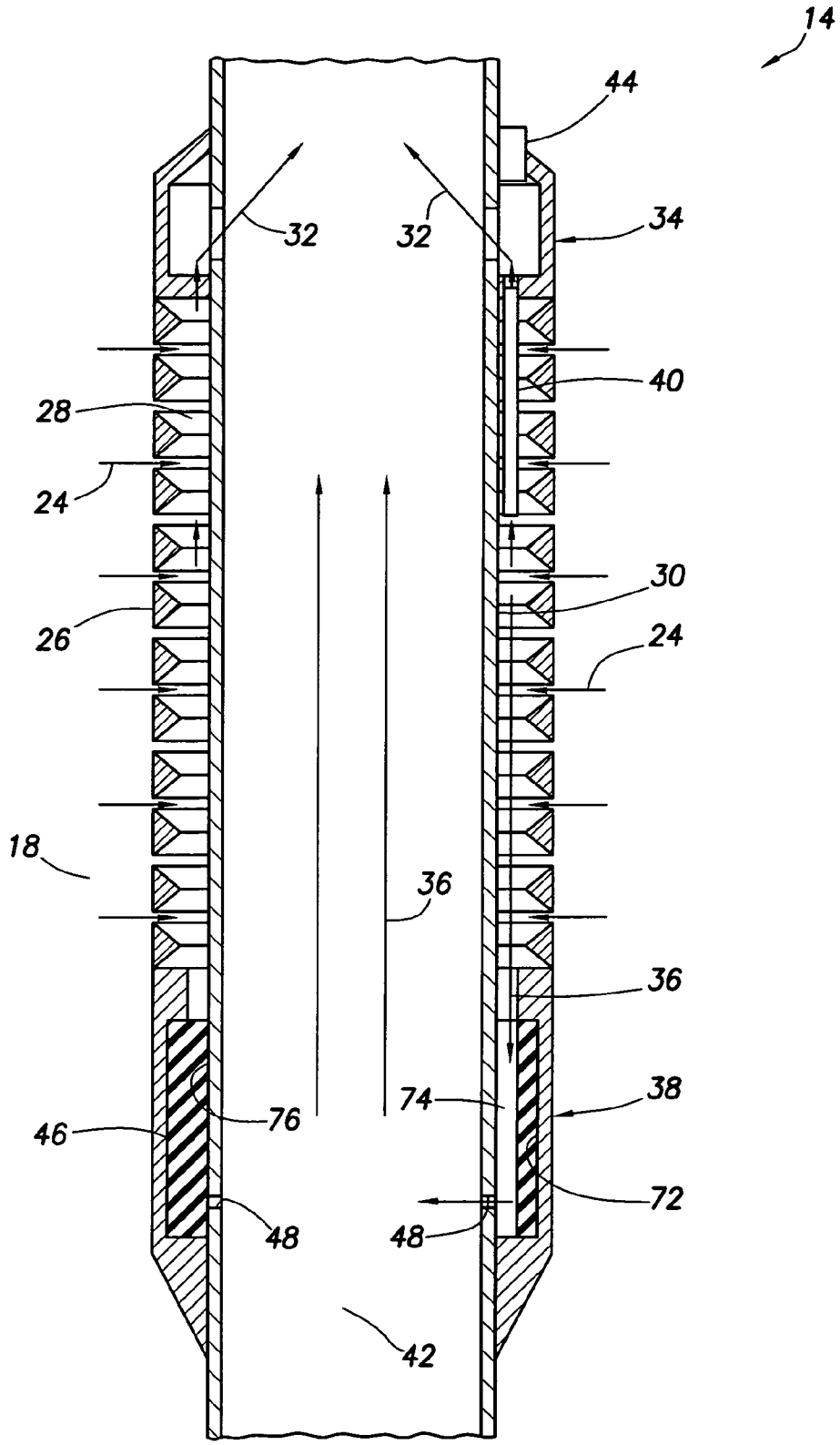
FIG. 7 is a schematic cross-sectional view of a third alternate construction of the well screen, a bypass device of the screen being shown closed on a left-hand side of the figure, and the bypass device of the screen being shown open on a right-hand side of the figure.

Referring additionally now to FIG. 7, another alternate configuration of the screen 14 is representatively illustrated. On a right-hand side of the screen 14 as viewed in FIG. 7, the bypass device 38 is open, and on a left-hand side of the screen the material 46 has swollen to thereby close the bypass device.

In this embodiment the swellable material 46 is bonded to an inner surface 72 of an outer tubular component of the bypass device 38, thereby forming an annular space 74 between an inner surface of the swellable material and an outer surface 76 of an inner tubular component of the bypass device. Prior to and during a gravel packing operation, relatively unrestricted flow is permitted through this annular space 74 of the bypass device 38. When the swellable material 46 swells radially inward in response to contact with a certain well fluid, the annular space 74 is closed or at least reduced in size so as to stop or at least increasingly restrict flow through the annular space.

Figure 8:
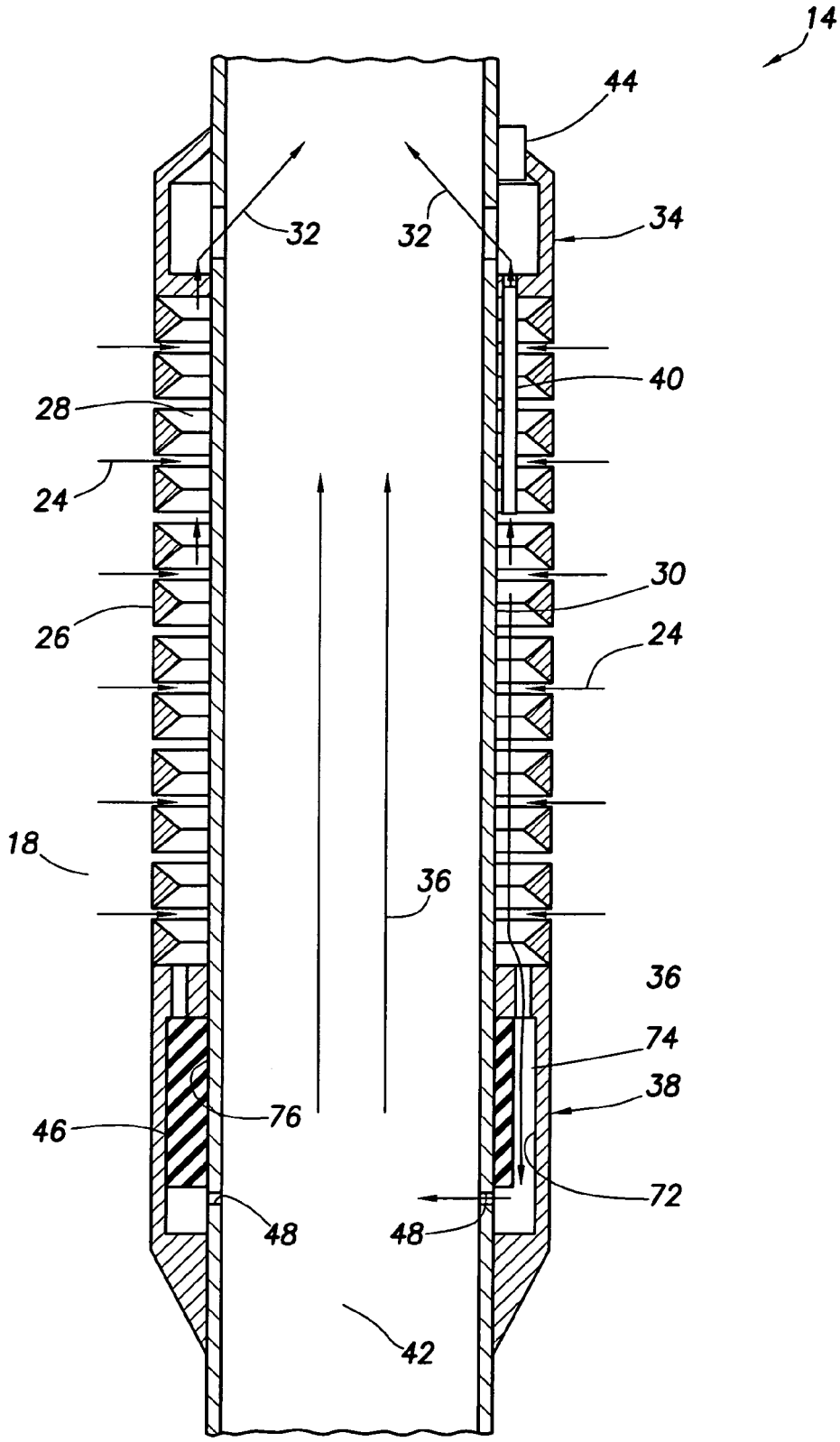
FIG. 8 is a schematic cross-sectional view of a fourth alternate construction of the well screen, a bypass device of the screen being shown closed on a left-hand side of the figure, and the bypass device of the screen being shown open on a right-hand side of the figure.

Another alternative embodiment of the device shown in FIG. 8 has the swellable material 46 bonded to the outer surface 76 of the inner tubular component of the bypass device 38, with the annular space 74 formed between the outer surface of the swellable material and the inner surface 72 of the outer tubular component of the bypass device. On a right-hand side of the screen 14 as viewed in FIG. 8, the bypass device 38 is open, and on a left-hand side of the screen the material 46 has swollen to thereby close the bypass device. The swellable material 46 would swell radially outward upon contact with a certain well fluid in order to close, or at least increasingly restrict, flow through the annular space 74.

In any of the embodiments of the bypass device 38 as shown in FIGS. 6-8, the surface with which the swellable material 46 makes contact may be enhanced so as to aid in the swellable material effecting a seal against that receiving surface. The surface may be roughened or it may be undulating, corrugated, or otherwise made non-smooth so as to enhance the sealing capability of the swellable material 46 when it contacts the receiving surface.

Figure 9:
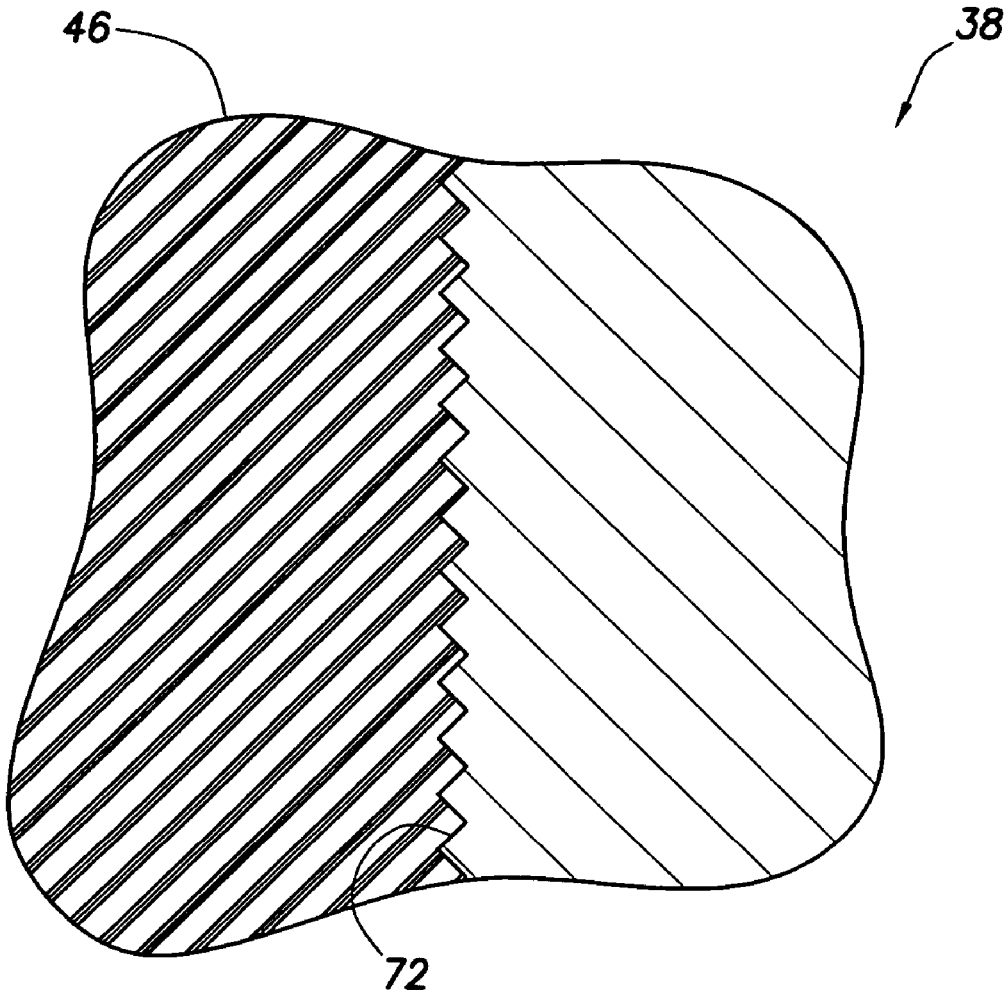
FIG. 9 is an enlarged scale schematic cross-sectional view of a swellable material of a bypass device sealingly contacting a surface of the bypass device.

An example of such surface treatments is shown in FIG. 9. The inner surface 72 of the bypass device 38 is contacted by the material 46, as in the embodiment of FIG. 8. In the example shown in FIG. 9, the inner surface 72 has serrations or ridges formed thereon to enhance sealing contact between the material 46 and the surface.

It should be understand that, although the screen 14 has been described above as being used in a gravel packing operation and in the well system 10 in which the screen is gravel packed, it is not necessary for the screen to be used in such gravel packing operations or well systems. For example, the screen 14 (or any screen incorporating principles of the invention) could be used in well systems where the screen is not gravel packed, or in operations where a restriction to flow through the screen is not increased in relation to any gravel packing operation.

It may now be fully appreciated that the well screen 14 and its many embodiments described above provide significant improvements in the art. Note that, in each of the embodiments of FIGS. 2-8, the fluid portion 36 which flows through the bypass device 38 flows in parallel with the fluid portion 32 which flows through the flow restricting device 34. In this manner, the closing or increased restriction to flow through the bypass device 38 which results from swelling of the material 46 causes an increased proportion of the fluid 52 to flow through the flow restricting device 34. Another manner of describing this feature is that the fluid portion 36 which flows through the bypass device 38 does not necessarily flow through the flow restricting device 34, and the fluid portion 32 which flows through the flow restricting device does not necessarily flow through the bypass device.

One advantage to using a well screen incorporating principles of the invention would be to enable higher flow rates, either production or injection, during an initial phase of installation, following which phase the actuation of the bypass device will function to restrict all or most flow from or into the well to no more than that allowed through the flow restricting device. Such an initial phase of higher production or injection rate may benefit the well by enabling it to maintain a higher sustained production or injection over the life of the well.

Well screens incorporating principles of the invention may be used in injection or production operations without gravel packing. Screens incorporating principles of the invention may be used to permit a large initial flow rate, for example, to aid in breaking up a filter cake lining the wellbore, or to permit high flow rate acidizing or other stimulation treatments, prior to long term production or injection.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. For example, it will be appreciated that bypass devices may be constructed without the use of swellable material, since other types of valves or chokes may be used which do not utilize swellable material. Accordingly, the foregoing detailed description is to be clearly understood as being given by way of illustration and example only, the spirit and scope of the present invention being limited solely by the appended claims and their equivalents.

What is claimed is:

1. A method of gravel packing a well, the method comprising the steps of:

installing a well screen in the well, the screen including a flow restricting device which restricts flow through the screen, and a bypass device for selectively permitting relatively unrestricted flow through the screen;

flowing gravel about the screen; and actuating the bypass device in response to contact between a material of the bypass device and fluid in the well, thereby increasingly restricting flow through the screen, and the actuating step further comprising forcing an increased proportion of inward flow through the screen to pass through the flow restricting device.

2. The method of claim 1, wherein the gravel flowing step is performed while the bypass device permits relatively unrestricted flow through the screen.

3. The method of claim 1, wherein the bypass device actuating step is performed after the gravel flowing step.

4. The method of claim 1, wherein the actuating step further comprises swelling the material in response to the contact between the fluid and the material.

5. The method of claim 4, wherein the swelling step further comprises restricting flow through at least one passage with the swollen material.

6. The method of claim 4, wherein the swelling step further comprises displacing a member with the swollen material.

7. A well system, comprising:

a well screen including a flow restricting device for restricting flow through the screen, and a bypass device for varying a proportion of the flow which passes through the flow restricting device, the bypass device including a material which swells in response to contact between the material and fluid in the well; and a gravel pack about the screen, wherein the gravel pack is installed about the screen prior to the bypass device increasing the proportion of the flow which passes through the flow restricting device.

8. The well system of claim 7, wherein the bypass device includes at least one passage, the flow through the passage being increasingly restricted when the material swells.

9. The well system of claim 8, wherein the material restricts flow through the passage when the material swells.

10. The well system of claim 8, wherein the material displaces a member to thereby increasingly restrict flow through the passage when the material swells.

11. The well system of claim 8, wherein the bypass device includes a valve, and wherein the material is included in an actuator for the valve.

12. A method of gravel packing a well, the method comprising the steps of:

installing a well screen in the well, the screen including a flow restricting device which restricts flow through the screen, and a bypass device for selectively permitting relatively unrestricted flow through the screen, flow through the flow restricting device and flow through the bypass device being in parallel;

flowing gravel about the screen; and actuating the bypass device, thereby increasingly restricting flow through the screen, the actuating step further comprising forcing an increased proportion of inward flow through the screen to pass through the flow restricting device.

13. The method of claim 12, wherein the gravel flowing step is performed while the bypass device permits relatively unrestricted flow through the screen.

14. The method of claim 12, wherein the bypass device actuating step is performed after the gravel flowing step.

15. The method of claim 12, wherein the actuating step further comprises swelling a material in response to contact between the material and fluid in the well.

16. The method of claim 15, wherein the swelling step further comprises restricting flow through at least one passage with the swollen material.

17. The method of claim 15, wherein the swelling step further comprises displacing a member with the swollen material.

* * * * *